US010337708B2

(12) United States Patent
Grant et al.

(10) Patent No.: US 10,337,708 B2
(45) Date of Patent: Jul. 2, 2019

(54) LENGTH ALTERATION TOOL FOR LIGHTING

(71) Applicant: Cooper Technologies Company, Houston, TX (US)

(72) Inventors: Andrew J. Grant, Houston, TX (US); Allen Coogler, Cleveland, TX (US)

(73) Assignee: COOPER TECHNOLOGIES COMPANY, Houston, TX (US)

( * ) Notice: Subject to any disclaimer, the term of this patent is extended or adjusted under 35 U.S.C. 154(b) by 700 days.

(21) Appl. No.: 14/925,522

(22) Filed: Oct. 28, 2015

(65) Prior Publication Data

US 2016/0116144 A1 Apr. 28, 2016

Related U.S. Application Data

(60) Provisional application No. 62/069,812, filed on Oct. 28, 2014.

(51) Int. Cl.

| | |
|---|---|
| ***F21V 21/00*** | (2006.01) |
| ***F21V 21/22*** | (2006.01) |
| ***F21V 21/36*** | (2006.01) |
| *F21W 131/10* | (2006.01) |

(52) U.S. Cl.

CPC ..... *F21V 21/22* (2013.01); *F21V 21/36* (2013.01); *F21W 2131/10* (2013.01)

(58) Field of Classification Search

CPC ..... B25G 1/04; B25J 1/04; F21V 21/406
USPC ..... 294/175, 210
See application file for complete search history.

(56) References Cited

U.S. PATENT DOCUMENTS

| | | | | |
|---|---|---|---|---|
| 2,490,125 | A | 12/1949 | Greppin | |
| 2,642,246 | A | 6/1953 | Stephans | |
| 3,410,995 | A | 11/1968 | Gray | |
| 4,152,757 | A | 5/1979 | Bilson et al. | |
| 4,390,933 | A | 6/1983 | Warshawsky | |
| 4,527,225 | A | 7/1985 | Hartman | |
| 8,845,151 | B1 | 9/2014 | Hale | |
| 2003/0137847 | A1 | 7/2003 | Cooper | |
| 2006/0146550 | A1 | 7/2006 | Simpson et al. | |
| 2006/0279948 | A1* | 12/2006 | Tsai | F16B 7/1454 362/190 |
| 2007/0297165 | A1 | 12/2007 | Watson et al. | |

(Continued)

FOREIGN PATENT DOCUMENTS

| | | | |
|---|---|---|---|
| KR | 10-0754924 | B1 | 9/2007 |
| KR | 10-0925347 | B1 | 11/2009 |
| KR | 20-0470131 | Y1 | 12/2013 |

OTHER PUBLICATIONS

International Search Report and Written Opinion of Corresponding Application No. PCT/US2015/057827; dated Feb. 5, 2016.

*Primary Examiner* — Gerald J Sufleta, II
(74) *Attorney, Agent, or Firm* — Pearne & Gordon LLP

(57) ABSTRACT

A system for accessing industrial lighting fixtures is described. The system may include a telescoping light pole having a light fixture at one end, a base support at an opposite end for securing the light fixture, and an electrical passage through tubular supports of the pole for providing power to the light fixture. The telescoping function of the light fixture may be supported by a biasing member inside the tubular supports. A tool for assisting in the extension and retraction of the fixture is also provided, as well as a mating device for mating the electrical passage with a port of an electrical enclosure.

11 Claims, 12 Drawing Sheets

(56) References Cited

U.S. PATENT DOCUMENTS

| | | | | |
|---|---|---|---|---|
| 2008/0302215 | A1* | 12/2008 | Johnson | H01J 9/003<br>81/53.12 |
| 2010/0244475 | A1* | 9/2010 | Hatcher | B25G 1/04<br>294/210 |
| 2014/0259534 | A1* | 9/2014 | Shields | B25G 1/04<br>16/429 |

* cited by examiner

LENGTH ALTERATION TOOL FOR LIGHTING

CROSS-REFERENCE TO RELATED APPLICATION

This application claims priority to U.S. Provisional Application Ser. No. 62/069,812, filed on Oct. 28, 2014, entitled "LENGTH ALTERATION TOOL FOR OUTDOOR INDUSTRIAL LIGHTING SUPPORT SYSTEM", the entirety of which is incorporated herein by reference.

BACKGROUND

The present disclosure relates generally to a length alteration tool for a telescoping light pole.

Lighting systems are used in many applications, with different constructions provided for different environments. Lighting is particularly important in industrial applications, which often require work in low light conditions. Adjustable lighting systems have been developed to safely lower the remote end (top end) of a light pole.

SUMMARY

Aspects of the present disclosure relate to extendable lighting fixture supports. General embodiments may include systems for accessing a plurality of outdoor lighting fixtures. An example system may include a plurality of extendable supports, each support associated with at least one of the plurality of outdoor lighting fixtures. Each support of the plurality of supports may comprise a lower support; an upper support movably engaging the lower support, the upper support being movable between an extended position and a retracted position; and a support locking assembly to selectively engage and disengage the upper support with the lower support. Systems may include a length alteration tool comprising: a lower section; an upper section telescopically engaging the lower section, the upper section being axially movable between an extended position and a retracted position; a biasing member biasing the upper section to the extended position; and a connection element on the upper section engageable to a selected support of the plurality of extendable supports. The system may have a first state wherein the corresponding upper support is supported only by the engaged support locking assembly and a second state wherein the connection element is engaged to bear the corresponding upper support while the corresponding support locking assembly is disengaged. In the second state, the connection element may operate to transfer substantially all the weight of the corresponding upper support to the upper section. The system may comprise at least one further connection element engageable to couple the lower section and at least one of: i) the corresponding lower support; and a pre-existing feature.

The corresponding lower support may be connected to the pre-existing feature. The corresponding upper support may comprise at least one protruding surface engageable by the connection element. The corresponding upper support may telescopically engage the corresponding lower support, the corresponding upper support being axially movable between the extended position and the refracted position. The connection element may be slideably movable along the longitudinal axis of the corresponding upper support.

The system may also comprise at least one lower connection element engageable to couple the lower section parallel to the corresponding lower support. The lower connection element may maintain the lower support in a substantially parallel relationship with the lower section, and the connection element may maintain the upper support in a substantially parallel relationship with the upper section.

The protruding surface may be fixed to the connection element substantially only by a component of earth's gravitational force along the longitudinal axis of the tool. The connection element may comprise at least one of i) a fork; ii) a bracket; and iii) a clamp. While the connection element is engaged to the selected one of the plurality of extendable supports and the corresponding support locking assembly is disengaged, movement of the upper section from the extended position to the retracted position may correspond with movement of the corresponding upper support from the corresponding extended position to the corresponding retracted position. The upper support may telescopically engage the lower support, the upper support being axially movable between the extended position and the retracted position.

The pre-existing feature may be an electrical enclosure comprising at least one of: i) an electrical conduit fitting, and ii) an electrical junction box. The length alteration tool comprises a section locking assembly selectively locking the upper section to the lower section.

One general embodiment of the disclosure is a method for accessing at least one of a plurality of outdoor lighting fixtures on a plurality of extendable supports. Each support is associated with at least one of the plurality of outdoor lighting fixtures and comprising a tubular lower support and an upper support movably engaging the lower support such that the upper support is movable between an extended position and a retracted position. The method may include positioning a length alteration tool proximate a selected support of the plurality of extendable supports. The length alteration tool may comprise a tubular lower section; an upper section telescopically engaging the lower section, the upper section being axially movable between an extended position and a retracted position; a biasing member biasing the upper section to the extended position; and at least one connection element on the upper section. The corresponding lower support may be connected to the pre-existing feature.

The method may comprise engaging the at least one connection element to an upper support element of the selected support while the upper support element is in a corresponding extended position and while a support locking assembly associated with the upper support element is in an engaged state locking the upper support with a tubular lower support; and moving the upper section through a path of travel from the corresponding extended position to a corresponding retracted position, comprising causing the at least one engaged connection element to bear the corresponding upper support by disengaging the support locking assembly.

The method may comprise transferring substantially all the weight of the corresponding upper support to the upper section with the at least one connection element.

The method may include securing the lower section against forces tangential to the path of travel. The step of securing the lower section comprises coupling together the lower section and at least one of: i) the corresponding lower support, and ii) a pre-existing feature, by engaging at least one further connection element.

The step of engaging the at least one connection element to the upper support element may include placing the connection element in abutment with at least one protruding surface on the upper support element. The step of engaging the at least one connection element to the upper support element may comprise extending the upper section along the longitudinal axis of the upper support element. The lower connection element may maintain the lower support in a substantially parallel relationship with the lower section; and the connection element may maintain the upper support in a substantially parallel relationship with the upper section.

The method may include constraining motion of one or more of the at least one connection element to a path substantially parallel to the upper support element. The step of constraining comprises slideably coupling the one or more of the at least one connection element to the lower section. The method may include engaging a section locking assembly of the length alteration tool to lock the upper section to the lower section.

Apparatus embodiments include a device for mating an electrical passage of a telescoping outdoor lighting support, having a tubular lower support fixedly mounted on a support structure, with a port of an electrical enclosure fixedly connected to an industrial electrical system in accordance with the present disclosure. The electrical passage may be disposed at a base end of the tubular lower support, the outdoor lighting support also including an upper support telescopically engaging the lower support, the upper support being axially movable between an extended position and a retracted position, the upper support having an upper end configured to receive a ballast lighting fixture and a lower end received in the lower support. The device may include an adaptor interposable between the electrical fluid-tight passage and the port of the electrical enclosure, the adaptor comprising (i) a first aperture that spatially conforms to a footprint of the electrical passage; and (ii) a second aperture that spatially conforms to a footprint of the port of the electrical enclosure.

The foregoing and other objects, features and advantages of the disclosure will be apparent from the following more particular descriptions of exemplary embodiments of the disclosure as illustrated in the accompanying drawings wherein like reference numbers generally represent like parts of exemplary embodiments of the disclosure.

BRIEF DESCRIPTION OF THE DRAWINGS

The following figures are part of the present specification, included to demonstrate certain aspects of embodiments of the present disclosure and referenced in the detailed description herein. Unless otherwise noted, figures are not drawn to scale.

DETAILED DESCRIPTION

Telescoping industrial light poles facilitate repair or maintenance of light fixtures atop the light pole by bringing the fixture to ground level. Particular designs enable a single worker to perform the action of raising and/or lowering the fixture, thereby reducing the costs of labor relating to maintenance. Providing wiring through an internal portion of the light poles protects the wiring from external elements, such as moisture and contact damage.

As part of the telescoping nature, an upper support (or upper pole) may be slidably engaged with a lower support (or lower pole). There may be intermediate supports provided between the upper and lower supports, if desired. The telescoping supports allow a light fixture coupled to the upper support to be moved up and down. A spring may be provided within one or more of the supports to provide assistance with the raising and/or lowering of the light fixture. Moreover, the light fixture can be raised or lowered within a vertical axis.

Specific design details have been provided for illustration, but should not be considered limiting. Those skilled in the art will recognize that many variations of telescoping pole support systems may be implemented consistent with the scope of the disclosure as described herein.

Figure 1:
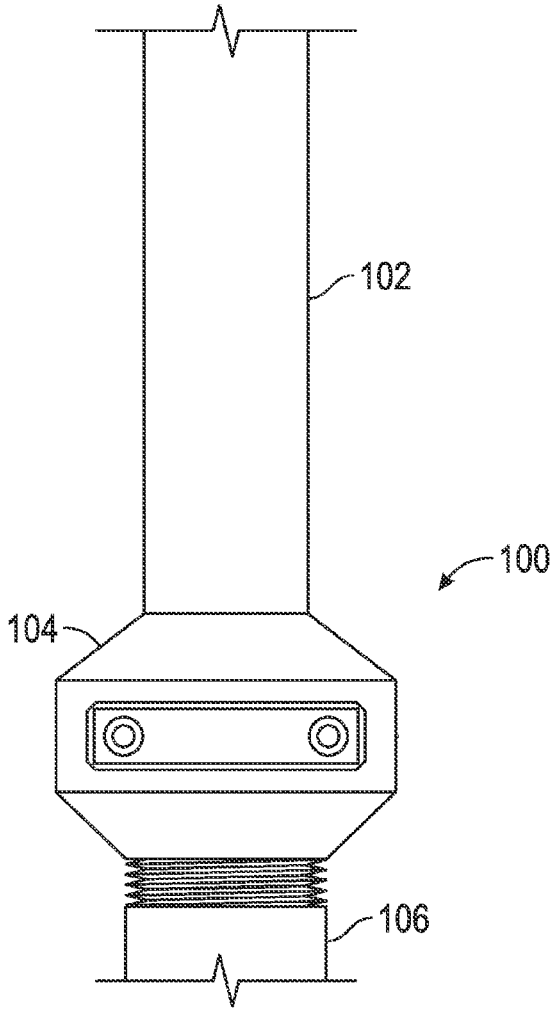
FIGS. 1-3 illustrate a pole support system for industrial lighting.
Figure 2:
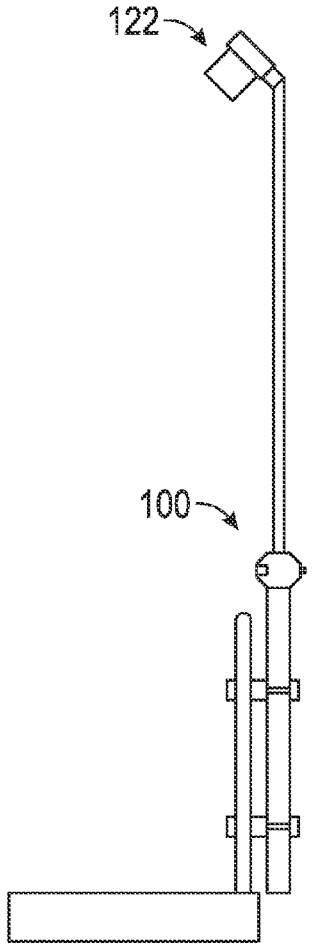
Figure 3:
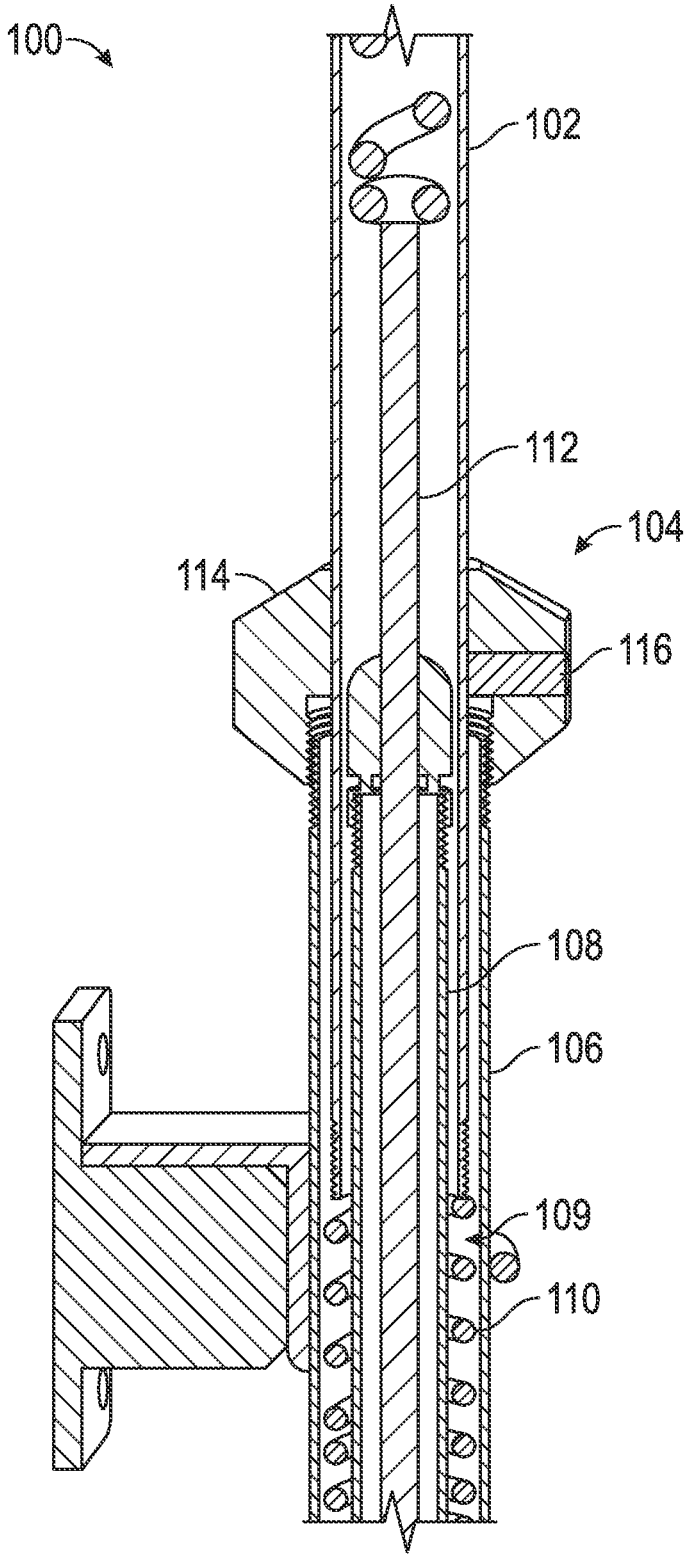

FIGS. 1-3 illustrate a pole support system that can be used in, for example, industrial lighting applications. Referring to FIGS. 1 and 2, the pole support system 100 comprises a lower support 106, a telescoping upper support 102, and a locking assembly 104 attached to the lower support 106. At least one of the upper support 102 and the lower support 106 may be tubular. Tubular as used herein may include, for example, tubes with cylindrical, rectangular, elliptical, or irregular cross-sections. The pole support system supports at least one light fixture 122. The light fixture 122 may be of any type. Upper support 102 and lower support 106 may be implemented, for example, as a 2-inch tubular support comprising aluminum, galvanized or stainless steel, or the like, or any other material as would operate in a consistent manner.

FIG. 3 shows a cross section of pole support system 100. The pole support system 100 further includes a guide member 108 interior to at least one of the upper support 102 and the lower support 106. As shown in FIG. 3, the guide member 108 may extend substantially along the length of the lower support 106. Substantially along the length of the lower support 106, as described herein, may be defined as a range spanning (at either end) from 18 inches longer to 6 inches shorter than the lower support. Other embodiments may include guide member 108 extending greater than 18 inches farther than the lower support 106.

Upper support 102 can extend inside the lower support 106 and is axially movable between an extended position and a retracted position. Alternatively, the upper support 102 can be of a larger cross-sectional area than the lower support 106 such that the lower support 106 extends into the upper support 102. Locking assembly 104 at least partially surrounds one of the upper support 102 and the lower support 106 at one end thereof. In the illustrated example, the upper support 102 may be at least partially received in an annular space 109 between the lower support 106 and the guide member 108. The guide member 108 may be concentric with the lower support 106 and/or upper support 102. A support biasing member 110 in the annular space 109 biases the upper support 102 to the extended position. The support biasing member 110 may be implemented as a spring (as shown), an elastomeric member, a pneumatic or hydraulic system, and so on.

In operation, a light fixture 122 is accessible by adjusting the pole support system height via lowering the upper support 102. The telescoping connection between the upper support 102 and the lower support 106 is aided by the "spring assist" from the support biasing member 110. The spring assist reduces the amount of strength needed to raise or lower the upper support to a desired height. The light fixture 122 is secured at a desired height by the locking assembly 104.

The locking assembly 104 includes a sloped portion, such as a chamfer, to resist standing water while maintaining structural strength. Other embodiments may include an arched upper surface, a level upper surface, or other designs. The lower surface may be the same or different than the upper surface. It is to be understood that varying designs may have associated advantages and disadvantages that recommend their use, and that all such variations are within the scope of the present disclosure.

Figure 4A:
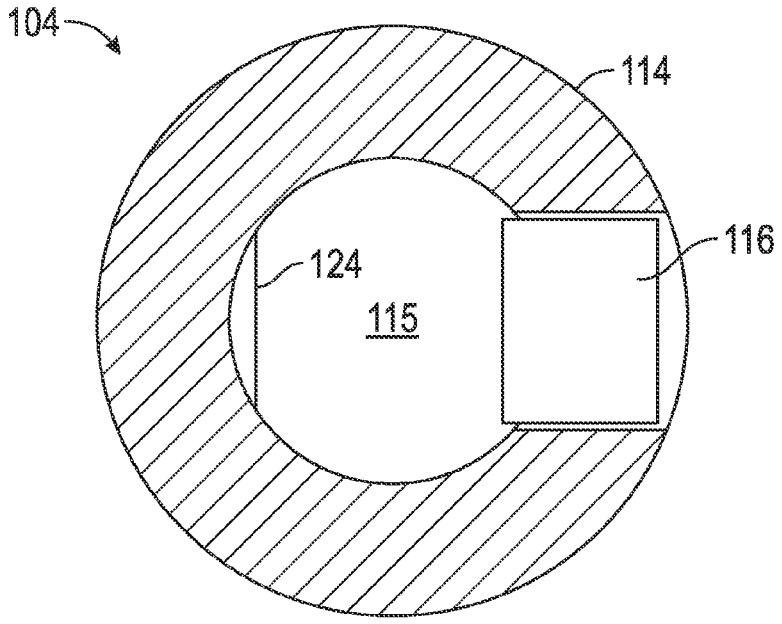
FIGS. 4A and 4B illustrate locking assemblies in accordance with embodiments of the present disclosure.
Figure 4B:
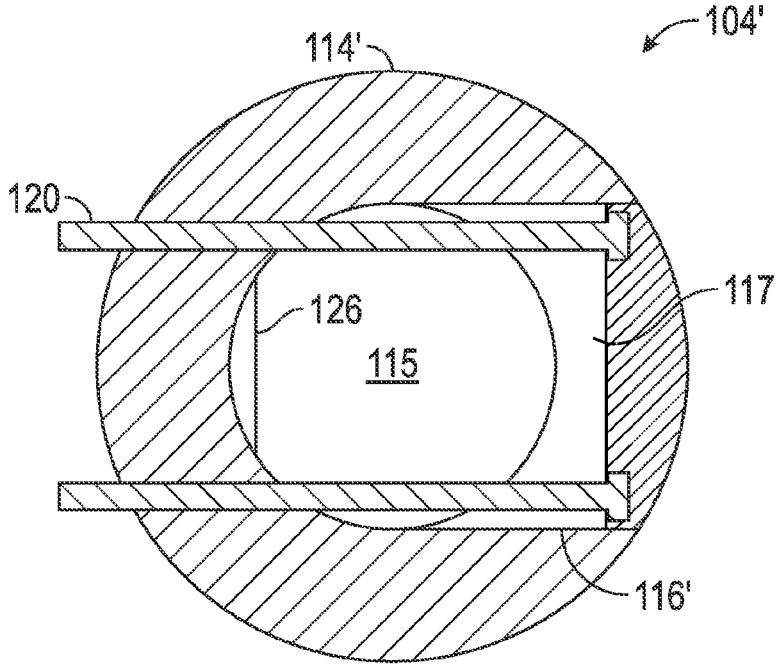

FIGS. 4A and 4B illustrate example locking assemblies. The locking assembly 104 includes a body 114 having a passage 115 in which the upper support 102 (FIG. 3) slides therethrough. The passage 115 may be tailored to the upper support 102 to allow sliding translation of upper support 102 while discouraging ingress of moisture and particulates. The body 114 is attached to the lower support 106 to enclose the passage 115 at a first end while maintaining the passage 115 in fluid communication with the interior of the lower support 106. The body 114 may be attached to the lower support 106 by at least one selectably sealingly engageable fastener (e.g., via threaded connection or mechanical seal), by use of adhesives, epoxies, or resins, or other fasteners.

In addition, the locking assembly includes a lock 116 that is configured to selectably engage the upper support 102 to constrain axial motion of the upper support 102. To facilitate maintaining the desired position of the upper support 102, the locking assembly 104 further includes a raised surface 124 in the passage. As depicted in FIG. 4A, the raised surface 124 is positioned across from the lock 116 to further secure the upper support 102 while the support 102 is engaged with the lock 116. It should be understood that the lock 116 may be implemented using various fasteners or biasing mechanisms.

Turning to FIG. 4B, by way of example, the lock 116' may be a translational member 117 configured to translate into the passage 115 against the upper support 102 in response to tightening of threaded bolts 120 into corresponding threaded channels (not shown) in the body 114'. The locking assembly 104' further includes a raised surface 126 in the passage 115 opposite the translational member 117, implemented as a ledge (e.g., a flat surface against which the upper support 102 is held upon engaging the lock 116'). Other embodiments of the lock 116, 116' may employ corresponding nuts or the like, may use clasps or other fasteners, or may operate using rotational versus translational motion. Any type of fastener may be used to engage the lock 116, 116'.

With respect to the pole support systems of FIGS. 1-3, an electrical system is routed through the lower and upper supports and provides power to the light fixture 122. Additional aspects of the present disclosure may also include wiring 112 interior to the upper and lower support members and the guide member 108 as demonstrated in FIG. 3. The guide member 108 may be implemented as fluid-tight electrical conduit or similar fluid-tight structure. Additionally or alternatively to the guide member 108, a wiring chamber may be interior to the lower support 106.

Figure 5A:
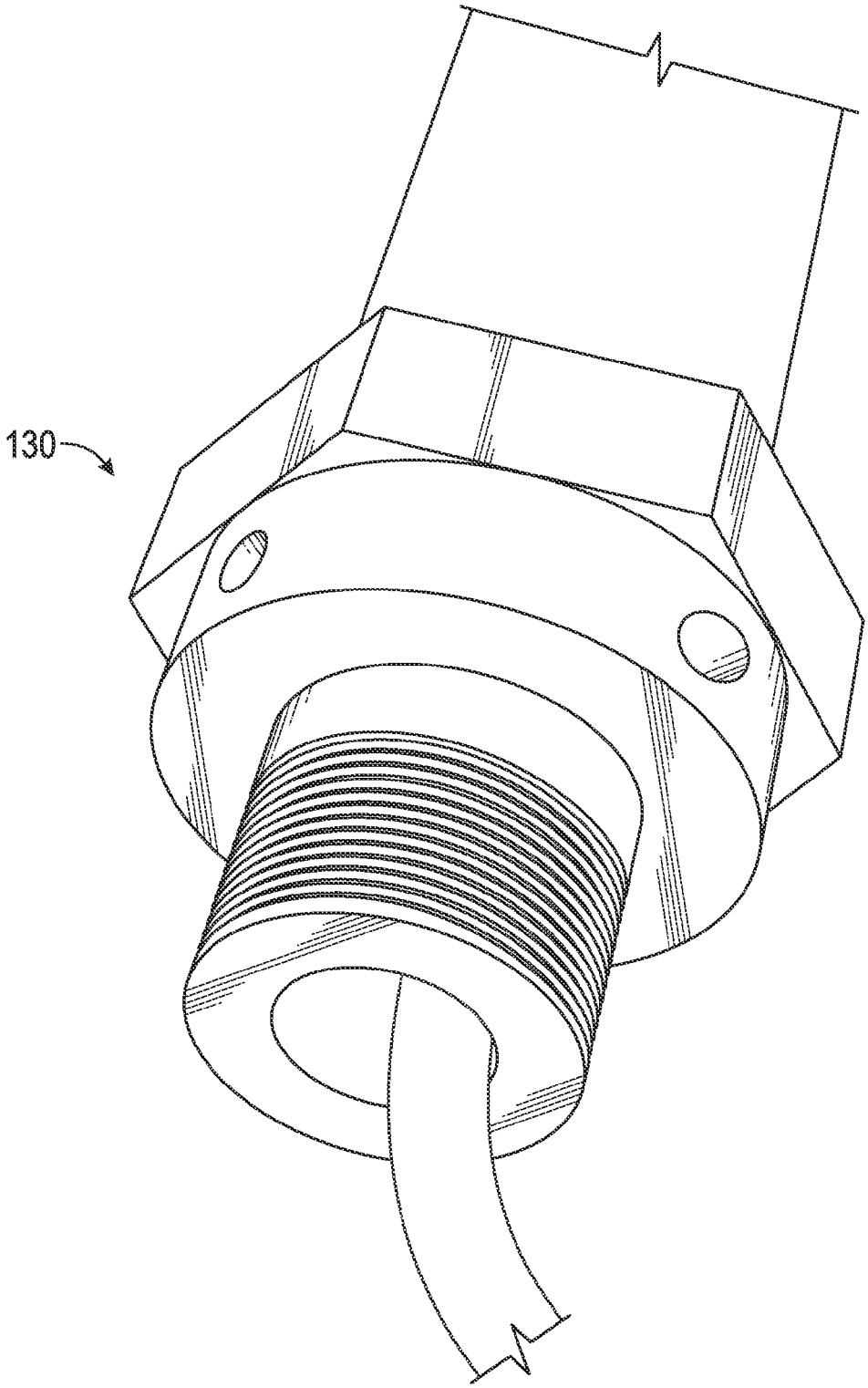
FIGS. 5A-5D illustrate a base in accordance with embodiments of the present disclosure.
Figure 5B:
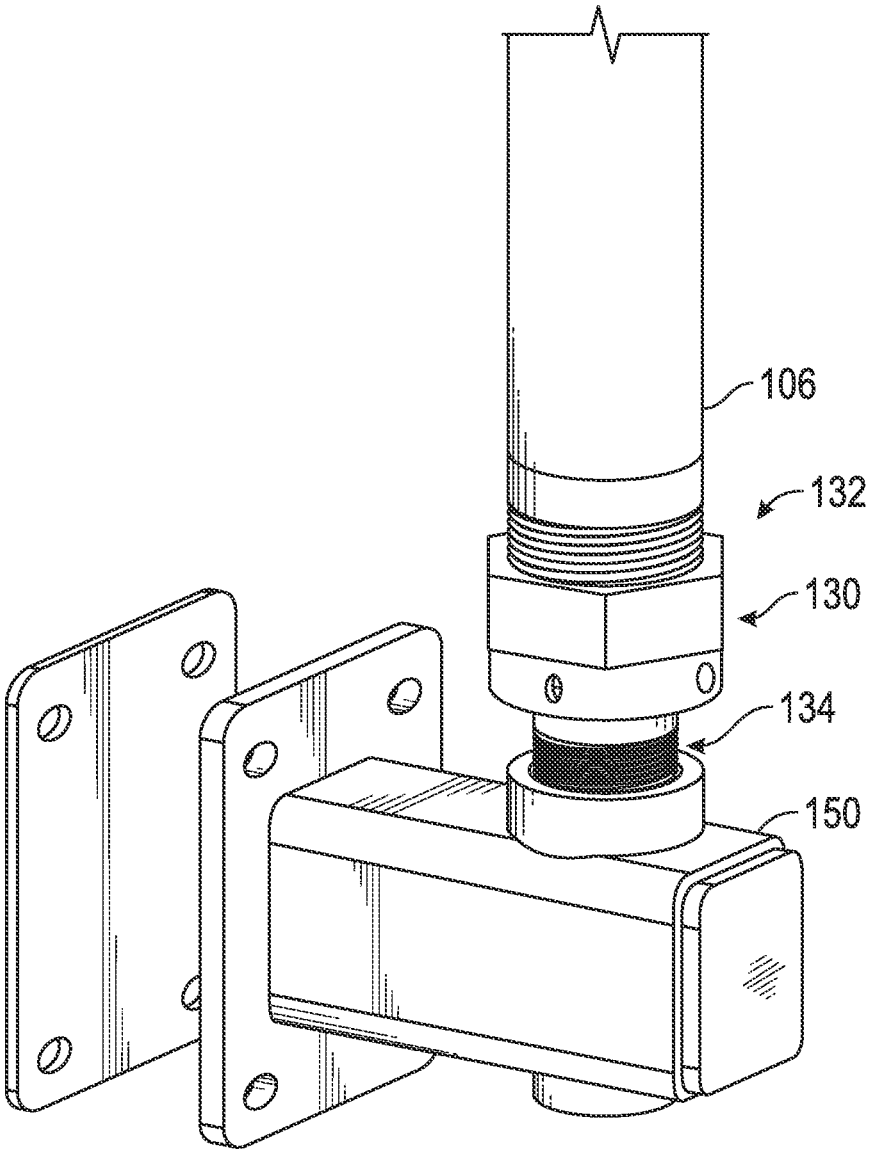
Figure 5C:
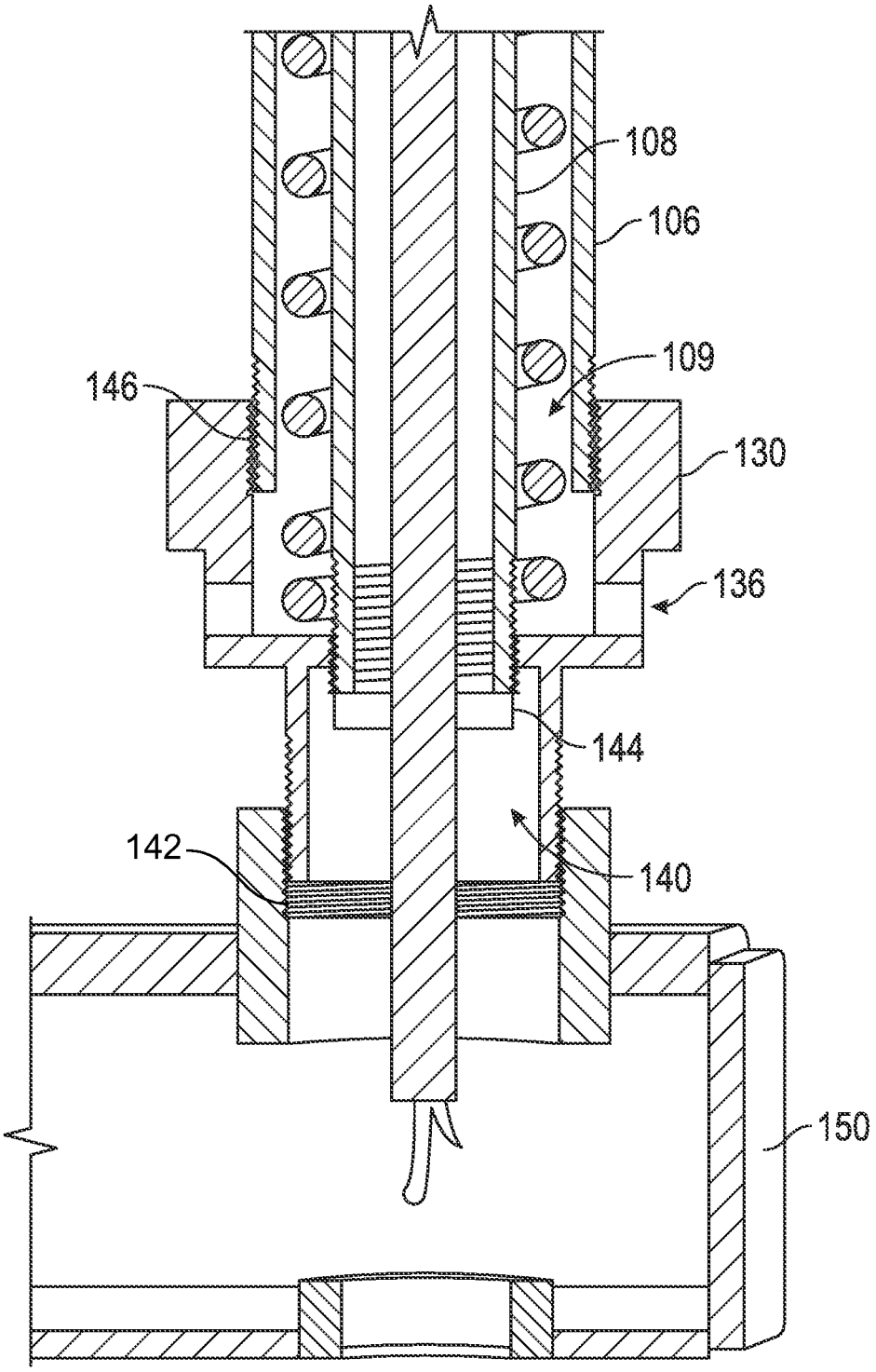
Figure 5D:
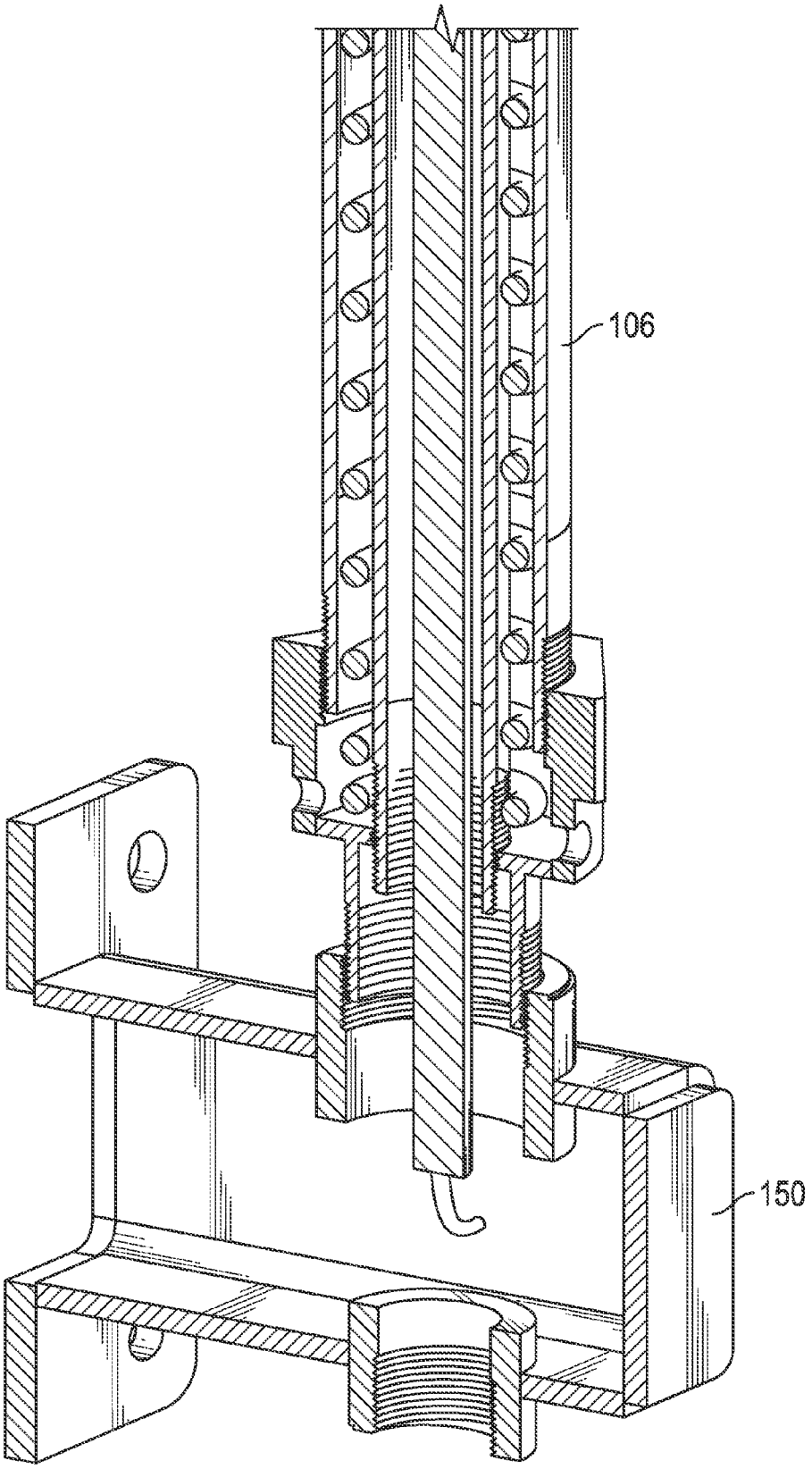

Turning to FIGS. 5A-5D, a base is illustrated in accordance with the pole support systems described herein. Base 130 includes a channel 140 (FIG. 5C) located between a first end portion 132 of the base 130 and a second end portion 134 of the base 130 (FIG. 5B). The base 130 is configured for coupling with the guide member 108 (e.g., electrical conduit) and the lower support 106. In particular, the guide member 108 is coupled to the base 130 at the second end portion (134; a lower end portion of the base 130) such as by way of a threaded connection 144. Likewise, the lower support 106 couples to the base 130 at the first end portion (132; an upper end portion). In that regard, the lower support 106 can be threadably connected (146) to the base 130 at a terminal end of the lower support 106. Recall that the other end of the lower support 106 is attached to the locking assembly 104. The threaded connections 144 and 146 enable sealing engagement with the guide member 108 and the lower support 106. As a result of such connections, the base 130 is configured to isolate the interior of the guide member 108 from the annular space 109. Threaded connection 142 at the second end 134 enables sealing engagement with an interior of junction box 150. Weep holes 136 allow condensation or other moisture to drain from the annular space 109.

Figure 6A:
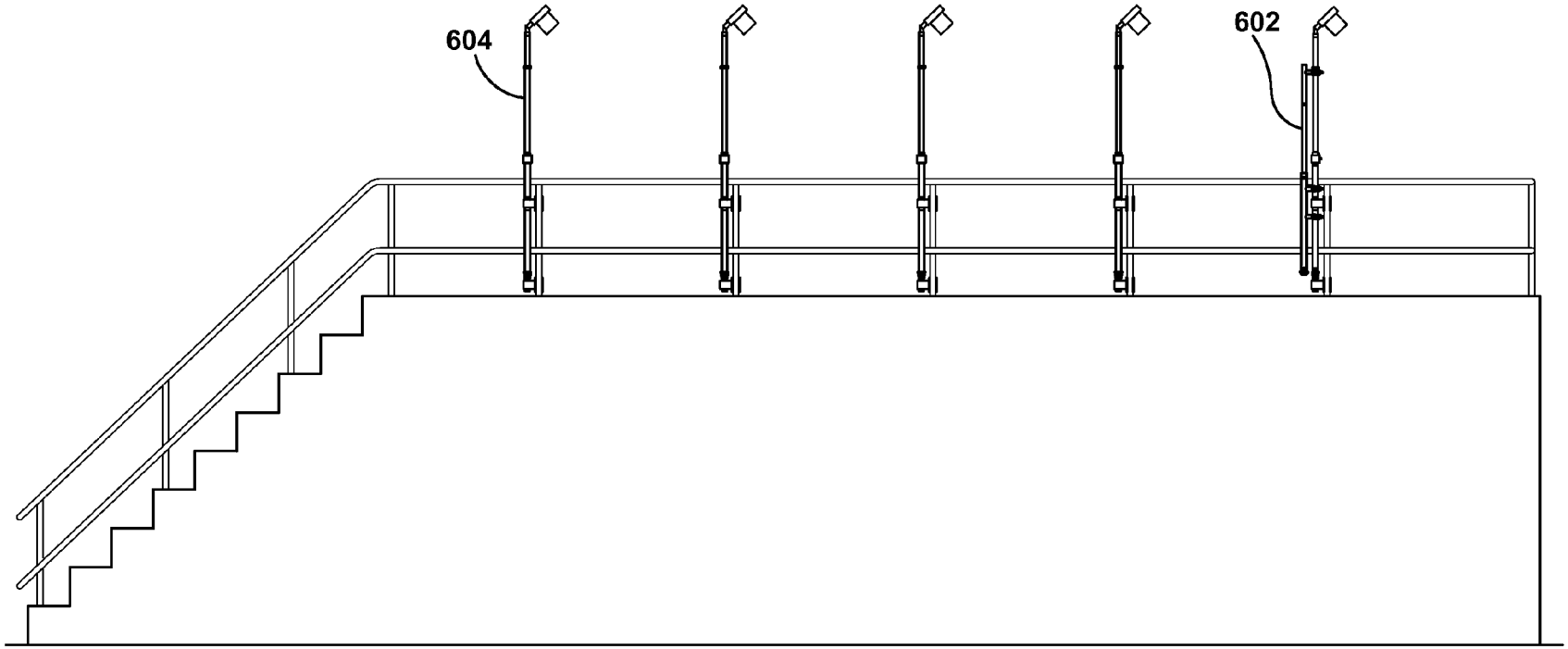
FIG. 6A illustrates a system of outdoor lighting fixtures in accordance with embodiments of the present disclosure.
Figure 6B:
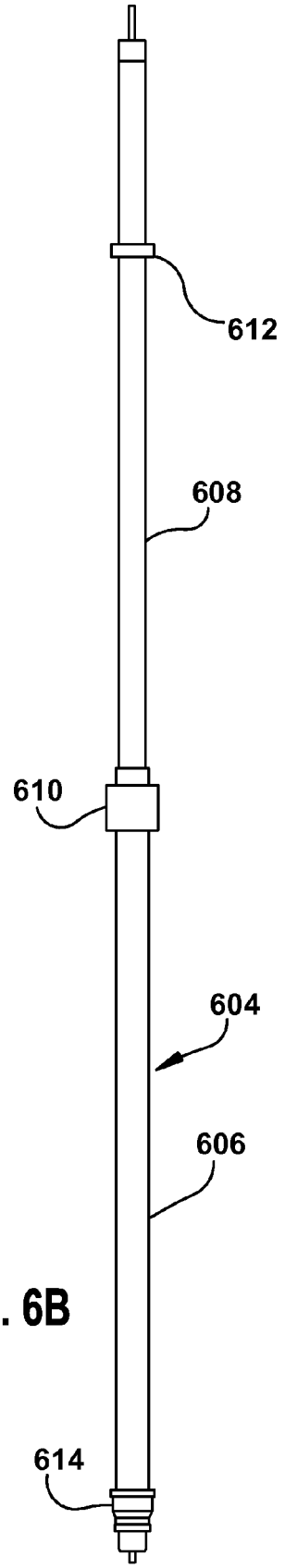
FIGS. 6B and 6C illustrate an extendable support for an outdoor lighting fixture in accordance with embodiments of the present disclosure.
Figure 6C:
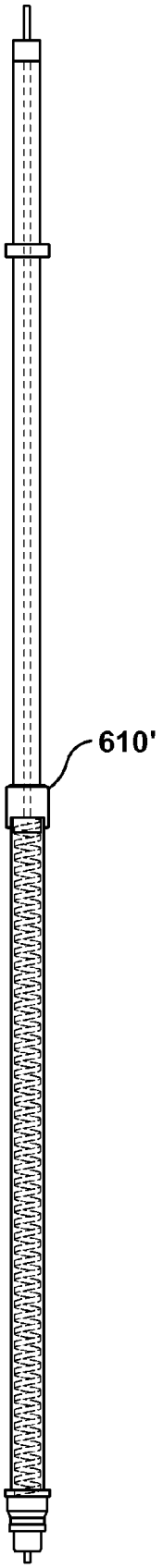

FIGS. 6A-6G illustrate a system for accessing a plurality of lighting fixtures, such as outdoor lighting fixtures. FIG. 6A is a schematic diagram illustrating that a single tool 602 may be used to raise and lower a plurality of extendable supports 604, which can be installed in an industrial facility, for example. FIGS. 6B and 6C illustrates an extendable support 604, which may be associated with at least one lighting fixture, e.g., by mounting the at least one lighting fixture on the extendable support 604. The support 604 includes a tubular lower support 606, or lower support element, and an upper support 608, or upper support element, movably engaging the lower support 606, such as, for example, by retracting into or over the lower support 606. Thus, the upper support 608 may be movable between an extended position and a retracted position. The upper support and lower support may be made of any suitable material such as carbon steel, aluminum, or stainless steel and selection thereof can depend on desired properties, such as weight, strength, resistance to particular environmental conditions, cost, and so on.

The support 604 also includes a support locking assembly 610, which may be selectively switched between an engaged state locking the upper support 608 with the lower support 606 and a disengaged state allowing movement of the upper support with respect to the lower support. The support locking assembly 610 is shown as a thumb type worm clamp or as a two piece top pole locking mechanism 610', but may be implemented as any suitable locking assembly. The support locking assembly 610 may optionally be covered by a protective sleeve or cover, such as one made of elastomeric material. The support 604 may also include a protruding surface, such as collar 612, or other connection components of a mechanical, electrical or hydraulic nature. Collar 612 may be coupled to the support 604 via a suitable locking mechanism or can be materially integrated into upper support 608. The upper end of the upper support 608 may be joined with a lighting fixture via threaded engagement. The base end of the lower support 606 may include a connector 614 configured to connect with a pre-existing feature, such as for example, an electrical conduit fitting (e.g., a "T" fitting), electrical junction box, other electrical enclosure, and so on.

Figure 6D:
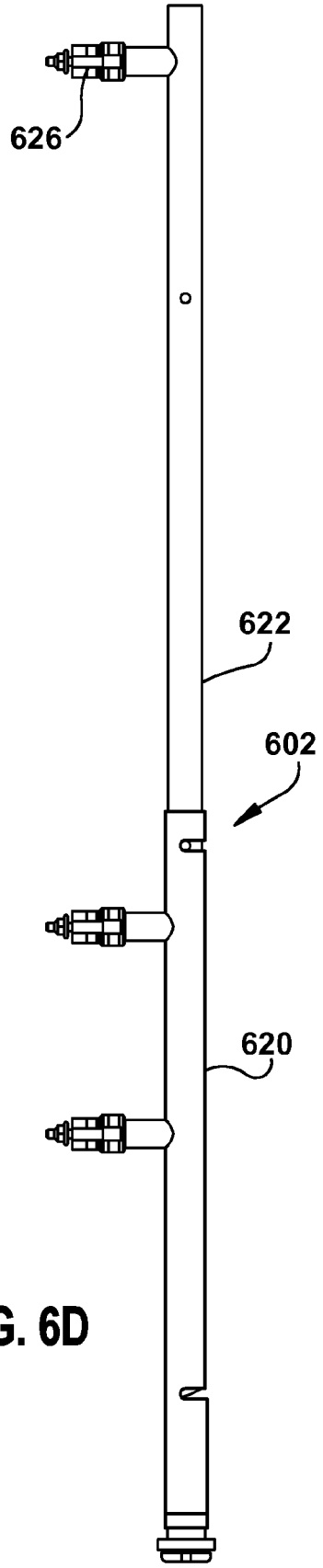
FIGS. 6D and 6E illustrate front and side views of length alteration tool for an outdoor lighting fixture in accordance with embodiments of the present disclosure.
Figure 6E:
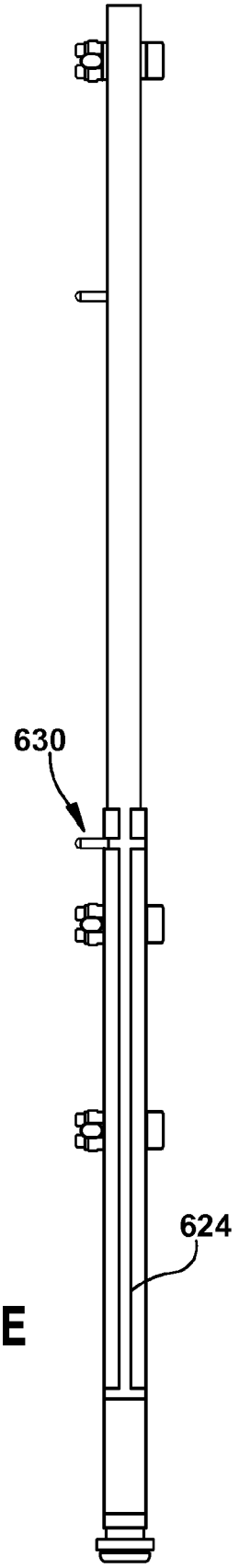
Figure 6F:
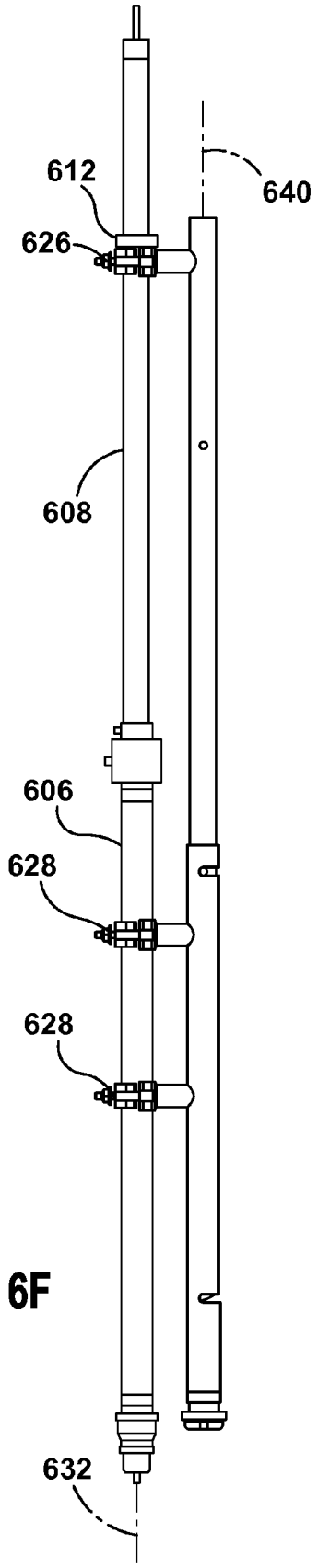
FIGS. 6F and 6G illustrate front and side views of a length alteration tool mated with an outdoor lighting fixture according to embodiments of the present disclosure.
Figure 6G:
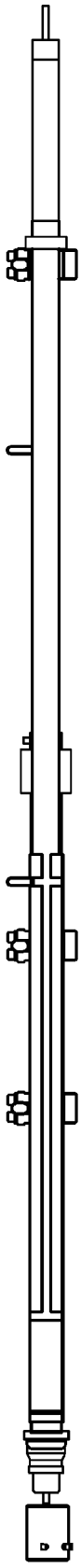

FIGS. 6D and 6E illustrates a length alteration tool 602, which may also be referred to as a lift assist tool. The length alteration tool 602 can be used for telescoping light poles that cannot be easily adjusted without assistance. For instance, in environments where light poles need to be rated for winds of over 300 miles per hour, the light poles may be tall and robust in design. However, it is to be appreciated that the length alteration tool 602 can be used in any application in which a user desires to raise and lower a telescoping upper support, such as for maintenance or repair. The length alteration tool 602 may include a tubular lower section 620; an upper section 622 telescopically engaging the lower section, the upper section being axially movable between an extended position (shown) and a retracted position; a tool biasing member 624 biasing the upper section to the extended position; and at least one connection element 626 on the upper section. The at least one connection element 626 is configured to engage a corresponding extendable support 604, as shown in FIGS. 6F and 6G. The length alteration tool 602 may include a section locking assembly 630 selectively locking the upper section 622 to the lower section 620. The at least one connection element 626 is shown as a scaffold clamp, but may be implemented as any type of suitable connection elements, such as a fork, bracket, clamp, or any other releasable coupling device, alone or in combination. Biasing Tool biasing member 624 can be a metal spring or it may alternatively be implemented as a gas compression spring; pneumatic, hydraulic or mechanical devices; or combinations of these. It is also to be appreciated that tool biasing member 624 may be external to the lower section 620.

FIGS. 6F and 6G illustrate the system wherein a length alteration tool 640 is engaged with a selected support of the plurality of supports. In order for the tool 640 to properly engage the support, the axis of the length alteration tool 640 (e.g., the upper and lower sections) and the axis of the support 632 (e.g., the upper and lower supports) are positioned substantially parallel to each other. The at least one connection element 626 of the length alteration tool 640 engages the upper support 608 via the collar 612. At least one further connection element 628 can be engaged to couple the lower section of the tool 640 with the corresponding lower support 606. The system may have a first state wherein the corresponding upper support is supported only by the engaged support locking assembly 610 and a second state wherein the connection element is engaged to bear at least a portion of or a substantial amount of the weight of the corresponding upper support while the corresponding support locking assembly 610 is disengaged. In the second state, the connection element may operate to transfer substantially all the weight of the corresponding upper support 608 to the upper section. The protruding surface (collar 612) can be engaged or coupled to the connection element substantially by a component of natural gravitational forces along the longitudinal axis of the tool 640.

In operation, the tool 602 is used for a number of extendable supports. Methods in accordance with embodiments of the present disclosure include positioning a length alteration tool proximate a selected support of the plurality of extendable supports; engaging the at least one connection element to an upper support element of the selected support while the upper support element is in a corresponding extended position and while a support locking assembly associated with the upper support element is in an engaged state, locking the upper support with a tubular lower support. This may be carried out, for example, by placing the connection element 626 (top clamp) proximate the upper support. It may include adjusting the connection element so that it at least partially surrounds the upper support. In the instant case, the clamp may be tightened to prevent dislodging, but still allowing free travel along the upper support until meeting the collar 612 or other connection element. Engaging the at least one connection element to the upper support element may comprise extending the upper section along the longitudinal axis of the upper support element, until engaging other connection elements on the upper support, e.g., placing the connection element in abutment with at least one protruding surface on the upper support element.

Methods may also include securing the lower section against forces tangential to the path of travel. Lower support elements or other structural components, including a pre-existing feature may be engaged using at least one further connection element 628. The lower support 606 may be connected to the pre-existing feature, as shown above.

An additional step may include moving the upper section through a path of travel from the corresponding extended position to a corresponding retracted position, which may include causing the at least one engaged connection element to bear weight of the corresponding upper support by disengaging the support locking assembly 610. That is, once the connection element 626 is engaged, the support locking assembly 610 may be disengaged.

While the connection element is engaged to the selected one of the plurality of extendable supports and the corresponding support locking assembly 610 is disengaged, movement of the upper section from the extended position to the retracted position may thus correspond with movement of the upper support 608 from the corresponding extended position to the corresponding retracted position. Thus, if there is a section locking assembly it may be disengaged to allow the biasing mechanism to hold all free traveling components of the system.

The biasing mechanism may be configured to resist the weight of the particular upper support, with or without a particular lighting fixture, such that the upper section remains at the same height when the section locking assembly is unlocked (neutral), resist less than this weight to allow the support to retract without intervention when the section locking assembly is unlocked, or resist more than this weight to allow the support to automatically extend without intervention (from a retracted position, e.g., after maintenance is completed) when the section locking assembly is unlocked. In the last case, a worker may have to pull down the joined upper support and upper section to achieve a retracted position.

Figure 7A:
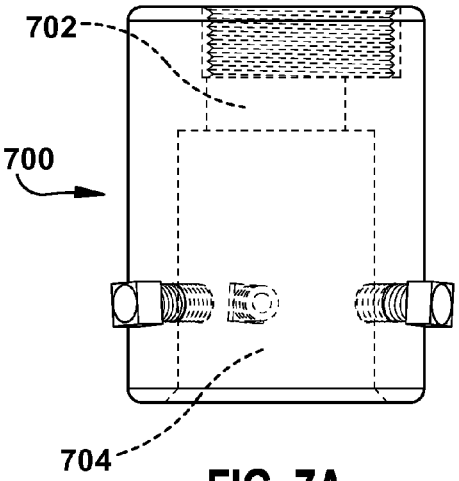
FIGS. 7A and 7B illustrate apparatus embodiments of a device for mating an electrical passage of a telescoping outdoor lighting support.
Figure 7B:
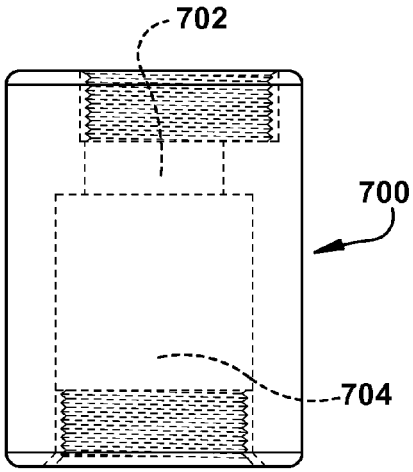

FIGS. 7A and 7B illustrate apparatus embodiments of a mating device 700 for joining an electrical passage of a telescoping pole support, having a tubular lower support fixedly mounted on a support structure, with a port of an electrical enclosure fixedly connected to an industrial electrical system in accordance with the present disclosure. The electrical passage may be disposed at a base end of the tubular lower support. The lighting or pole support also includes an upper support telescopically engaging the lower support, the upper support being axially movable between an extended position and a retracted position and the upper support having an upper end configured to receive a ballast lighting fixture and a lower end received in the lower support. The device 700 may include an adaptor interposable between the electrical fluid-tight passage and the port of the electrical enclosure, the adaptor comprising (i) a first aperture 702 that spatially conforms to a footprint of the electrical passage; and (ii) a second aperture 704 that spatially conforms to a footprint of the port of the electrical enclosure. The first aperture and second aperture of the adaptor may be on opposing ends of the adaptor, offset by forming an oblique angle between a first center of the first aperture and a second center of the second aperture, or offset wherein a center of the first aperture at a first surface of the adaptor and a center of the second aperture at a second surface of the adaptor form a horizontal displacement.

In various embodiments, the mating device 700 may utilize different forms of connection. For example, the device 700 may include socket style openings, the male end of the socket fitting being secured in the socket by bolts (as shown for the first aperture 702 in FIG. 7A) or threaded joints (as shown for the second aperture 704 in FIG. 7A and the first and second apertures 702, 704 in FIG. 7B).

The discussion above has described various aspects of pole support systems as applied to industrial light poles. It should be understood that this discussion may also apply to other types of elongate objects and in different types of environments. It should be further understood that the description provided herein may be subject to modifications consistent with operation of the pole support systems as described.

What is claimed is:

1. An outdoor light fixture system comprising:
an extendable support comprising:
a lower support;
an upper support coupled to the lower support, the upper support being movable between a raised position and a lowered position; and
a support locking assembly configured to lock the upper support with the lower support; and
a length alteration tool comprising a connection element configured to engage a corresponding portion of the upper support of the extendable support, wherein the length alteration further comprises:
a lower section; and
an upper section telescopically engaging the lower section, the upper section being axially movable between an extended position and a retracted position;
wherein the connection element is located on the upper section and is configured for engagement with the upper support of the extendable support; and
a tool biasing member, wherein the tool biasing member biases the upper section of the length alteration tool to the extended position.

2. The outdoor lighting fixture system of claim 1, wherein the tool biasing member biases the upper support in a raised position when the support locking assembly is disengaged and when the connection element is engaged with the upper support.

3. The outdoor lighting fixture system of claim 1, the length alteration tool further comprising a second connection element located on the lower section and is configured for engagement with the lower support of the extendable support.

4. The outdoor lighting fixture system of claim 3, wherein the lower section of the length alteration tool is substantially parallel with the lower support of the light fixture when the lower section is engaged with the lower support.

5. The outdoor lighting fixture system of claim 1, the upper support comprising a protrusion or a collar, wherein the connection element engages with the upper support by abutting against the protrusion or the collar.

6. The outdoor lighting fixture system of claim 5, wherein the connection element engages with the upper support by abutting against the protrusion or the collar by way of gravitational forces along a longitudinal axis of the length alteration tool.

7. The outdoor lighting fixture system of claim 1, wherein the connection element is a scaffold clamp.

8. An extendable support and length alteration tool system comprising:
an extendable support including:
a lower support;
an upper support, wherein the upper support is movable between an extended position and a retracted position with respect to the lower support; and
a connection surface; and
a length alteration tool including:
a lower section;
an upper section, wherein the upper section is movable between an extended position and a retracted position with respect to the lower section;
a connection element configured to engage the connected connection surface of the extendable support; and
a tool biasing member configured to bias the upper section to the extended position.

9. The system of claim 8, wherein the connection surface is provided on the upper support of the extendable support and the connection element is provided on the upper section of the length alteration tool.

10. The system of claim 8, further comprising a second connection element provided on the lower section of the length alteration tool to engage the lower support of the extendable support.

11. The system of claim 8, wherein the tool biasing member includes at least one of a metal spring, a gas compression spring, a pneumatic device, a hydraulic device, and a mechanical device.

* * * * *